US007421825B2

(12) United States Patent
Skendžić et al.

(10) Patent No.: US 7,421,825 B2
(45) Date of Patent: Sep. 9, 2008

(54) DOUBLY PRESTRESSED ROOF-CEILING CONSTRUCTION WITH GRID FLAT-SOFFIT FOR EXTREMELY LARGE SPANS

(75) Inventors: Milovan Skendžić, Lepoglava (HR); Branko Šmrček, Trnovec (HR)

(73) Assignee: Mara-Institut d.o.o., Donji Martijanec (HR)

( * ) Notice: Subject to any disclaimer, the term of this patent is extended or adjusted under 35 U.S.C. 154(b) by 58 days.

(21) Appl. No.: 10/489,978

(22) PCT Filed: Nov. 20, 2002

(86) PCT No.: PCT/HR02/00058

§ 371 (c)(1),
(2), (4) Date: Oct. 8, 2004

(87) PCT Pub. No.: WO03/083232

PCT Pub. Date: Oct. 9, 2003

(65) Prior Publication Data

US 2005/0039411 A1 Feb. 24, 2005

(30) Foreign Application Priority Data

Mar. 8, 2002 (HR) ..... P 20020208 A

(51) Int. Cl.
*E04C 3/02* (2006.01)
*E04C 3/11* (2006.01)

(52) U.S. Cl. ..... 52/223.8; 52/652.1; 52/653.1; 52/654.1; 52/81.6; 14/74.5

(58) Field of Classification Search ..... 52/652.1, 52/653.1, 654.1, 223.8, 223.11, 223.14, 86, 52/87, 81.6, 726.2, 653.2; 14/74.5, 13, 14
See application file for complete search history.

(56) References Cited

U.S. PATENT DOCUMENTS

| | | | | |
|---|---|---|---|---|
| 1,181,013 | A * | 4/1916 | Inglis | 14/4 |
| 2,202,850 | A | 6/1940 | Guignon, Jr. | |
| 2,415,709 | A * | 2/1947 | Sechaud et al. | 52/745.07 |
| 2,939,554 | A * | 6/1960 | Bolton et al. | 52/650.3 |
| 3,058,549 | A * | 10/1962 | Anderson | 52/127.1 |
| 3,562,994 | A * | 2/1971 | Linsowe | 52/650.2 |
| 3,750,697 | A * | 8/1973 | Kump | 137/356 |
| 3,858,374 | A | 1/1975 | Ben-Zvi | |

(Continued)

FOREIGN PATENT DOCUMENTS

DE 1156960 11/1963

(Continued)

*Primary Examiner*—Phi Dieu Tran A
(74) *Attorney, Agent, or Firm*—Jacobson Holman PLLC

(57) ABSTRACT

A doubly prestressed roof-ceiling construction with grid flat soffit for extremely large-span is a prefabricated element intended for assembling roofs of extremely large-span buildings with a flat soffit. The construction includes a grid soffit construction and an upper concrete girder of a modified "T" shape or of an inverse "V"-shaped cross section, interconnected by slender steel pipe-rods that stabilize the upper girder against lateral buckling. The empty openings within elements of the horizontal grid are fulfilled with plates wherewith a flat soffit is achieved. The construction is prestressed by the double prestressing. The grid-soffit is prestressed centrically and the upper girder is prestressed by a wedge at the midspan.

5 Claims, 5 Drawing Sheets

U.S. PATENT DOCUMENTS 4,144,686 A * 3/1979 Gold ..... 52/223.12
4,187,652 A * 2/1980 Bobrovnikov et al. ..... 52/90.1
4,489,659 A * 12/1984 Kamohara et al. ..... 104/124
4,947,599 A * 8/1990 Sadahiro ..... 52/223.12
5,008,967 A * 4/1991 Barrios et al. ..... 14/7
5,134,821 A * 8/1992 Sadahiro ..... 52/223.12
5,146,719 A * 9/1992 Saito et al. ..... 52/80.1
5,210,988 A 5/1993 Shaifer
5,784,842 A * 7/1998 Wackerbauer ..... 52/222
5,867,948 A * 2/1999 Liu ..... 52/80.1
6,332,301 B1 * 12/2001 Goldzak ..... 52/729.2
6,966,159 B2 * 11/2005 Skendzic et al. ..... 52/223.14

FOREIGN PATENT DOCUMENTS

DE 222 373 5/1985
HR P990305 A 6/2000
WO WO 01/11159 2/2001

* cited by examiner

DOUBLY PRESTRESSED ROOF-CEILING CONSTRUCTION WITH GRID FLAT-SOFFIT FOR EXTREMELY LARGE SPANS

This is a nationalization of PCT/HR02/00058 filed Nov. 20, 2002 and published in English.

TECHNICAL FIELD

The present invention relates to the construction of the roofs of industrial building or other similar buildings of prestressed, reinforced concrete and in particular some steel parts become integral parts of the structure. The field of the invention is described in IPC Classification E 04 B 1/00 that generally relates to constructions or building elements or more particularly group E 04 C 3/00 or 3/294.

BACKGROUND ART

The present invention relates to a specific roof-ceiling construction of the original conception and shape. The technical problem that is to be solved by this application is assembling method of constructing roofs with flat soffit over extremely large spans (more than 50 m) whereby the roof-ceiling construction solves both the roof and the finished flat soffit simultaneously. In practice, roof constructions over extremely large spans are mostly unique constructions carried out on special projects and usually constructed completely on the site.

The technical problem of this invention, if defined as a task, is to find out an assembling method of constructing roof-ceiling constructions over extremely large spans, suitable for serial pre-fabrication, as an alternative to customary practice of constructing unique constructions.

The technical problem that is to be solved is to divide the huge construction, unsuitable for transport and handling, into plurality of small assemblies that can be prefabricated and transported and assembled on site into the extremely large-span construction unit with flat soffit. As a part of the present invention some partial technical problems are to be solved such as; forming the light assembly-able soffit, lateral stabilization of the upper longitudinal girder over a large span without increasing its mass through increasing its lateral dimensions, longitudinal and transversal interconnecting of the assembly elements into the entirety. All the other solutions that are part of this invention are related to the practical use of the construction itself, including the advantages described in HR-P20000906A that these constructions offer when compared to other customary roof and ceiling constructions.

The present invention includes the basic concept of the construction and prestressing principles disclosed in U.S. Pat. No. 6,966,159under the name "doubly prestressed composite roof-ceiling constructions". The just-mentioned patent discloses constructions with flat plate-soffit over mostly used big spans up to 30 m. Such constructions with full-plate-ceilings are not suitable for spans bigger than 30 m because at spans larger than that the full-plate soffit becomes too weighty what modifies many assumptions which are the basis of the work of the construction at smaller spans making this construction inapplicable. For instance, the distinctly thin full plate, at spans up to 30 m, has the overall depth of 5 cm what provides enough depth for anchoring interconnecting bars into the soffit plate concrete to ensure them from pooling-out. The full, thin soffit-plate, if applied at large spans, requires an increment of depth because its connection to the upper longitudinal construction near supports become too weak to bear significant amount of shear. However, at very large spans the soffit plate should have an increased depth that would increase its self-weight and change the concept of its working mechanism based on the light soffit which deflects upwards due to rotation of ends of the construction. Moreover, constructions with full-plate soffit and a span over 50 m would be too long for transport and there would appear a problem of interconnecting smaller assemblies into the soffit plate entirety. Even if possible, carrying-out of such constructions would require pre-tensioning and concreting in site that may be uneconomic.

The present invention relates to a construction that is similar to the construction described in U.S. Pat. No. 6,966,159 and solves its applicability to extremely large spans, allows prefabrication of smaller assemblies that are assembled on site into the entirety and provides the assembling soffit formed by inserting light-plates into the openings of the grid-soffit reducing the weight of the entire construction before being hoisted.

No other similar constructions with flat soffit, except abovementioned ones are known to me.

DISCLOSURE OF THE INVENTION

The prestressed roof-ceiling construction for extremely large spans is pre-fabricated, one-way bearing construction, comprising grid flat soffit (1), the upper girder (2) and a plurality of space arranged stabilizing rods (3), attended for constructing buildings with extremely large spans solving both the roof and the ceiling with flat soffit simultaneously.

The object of the invention is, on contrary to customized unique large spans constructions establishment of a simpler and more economic, with adaptable spans, assembling system for constructing buildings with extremely large spans of pre-fabricated elements that are assembled into large segments of the construction—units that can be hoisted and interconnected into the large roof-ceiling with continuous flat soffit. The assembled light-grid, flat-soffit construction replaces a full-plate soffit whereby the flat soffit is achieved by inserting plurality of light plates into the openings within grid elements after the construction is assembled.

In some way it is an improvement of the likely constructions with flat soffit disclosed in U.S. Pat. No. 6,966,159 that provides a reasonable application of the same principle to extremely large spans (over 50 m).

The auxiliary technical solutions that are part of the present construction are; solutions that provide reduction of the self-weight of the entire construction to be applicable on extremely large spans, solution of stabilizing the upper girder (2) against lateral buckling without enlarging the mass of the construction by increasing lateral moment of inertia of its cross section, the solution of simple and practical interconnecting of pre-fabricated assemblies (1.1) of the grid construction (1) (in one embodiment the grid construction is made of steel tubes with a light foam filler and conductors that keep the inner cable distances) and the solution of forming the flat-soffit plane by inserting plurality of light plates (6) into openings within elements of the grid construction.

Generally, a solution of the static system for such constructions on extra large spans is achieved with slender pipe-bars (3) that do not transmit neither the bending moments between the upper girder (2) and the soffit grid (1) nor they are capable to transmit considerable axial forces and consequently can not bend the longitudinally slender grid (1) whereby the pipe-rods (3) are utilized simultaneously to stabilize the upper girder (2) against lateral buckling and to ensure stability of the grid plane itself during prestressing.

The cross sections of the upper girder (2) are of the original shapes as shown in FIG. 2 in both Version1 and Version2 which are constructed in such a manner to be light and adapted for the abovementioned function to stabilize the upper girder (2) which is braced by pipe-rods (3) anchored into the grid (1), substantially rigid in the horizontal plane.

DESCRIPTION OF THE PREFERED EMBODIMENT

Figure 1:
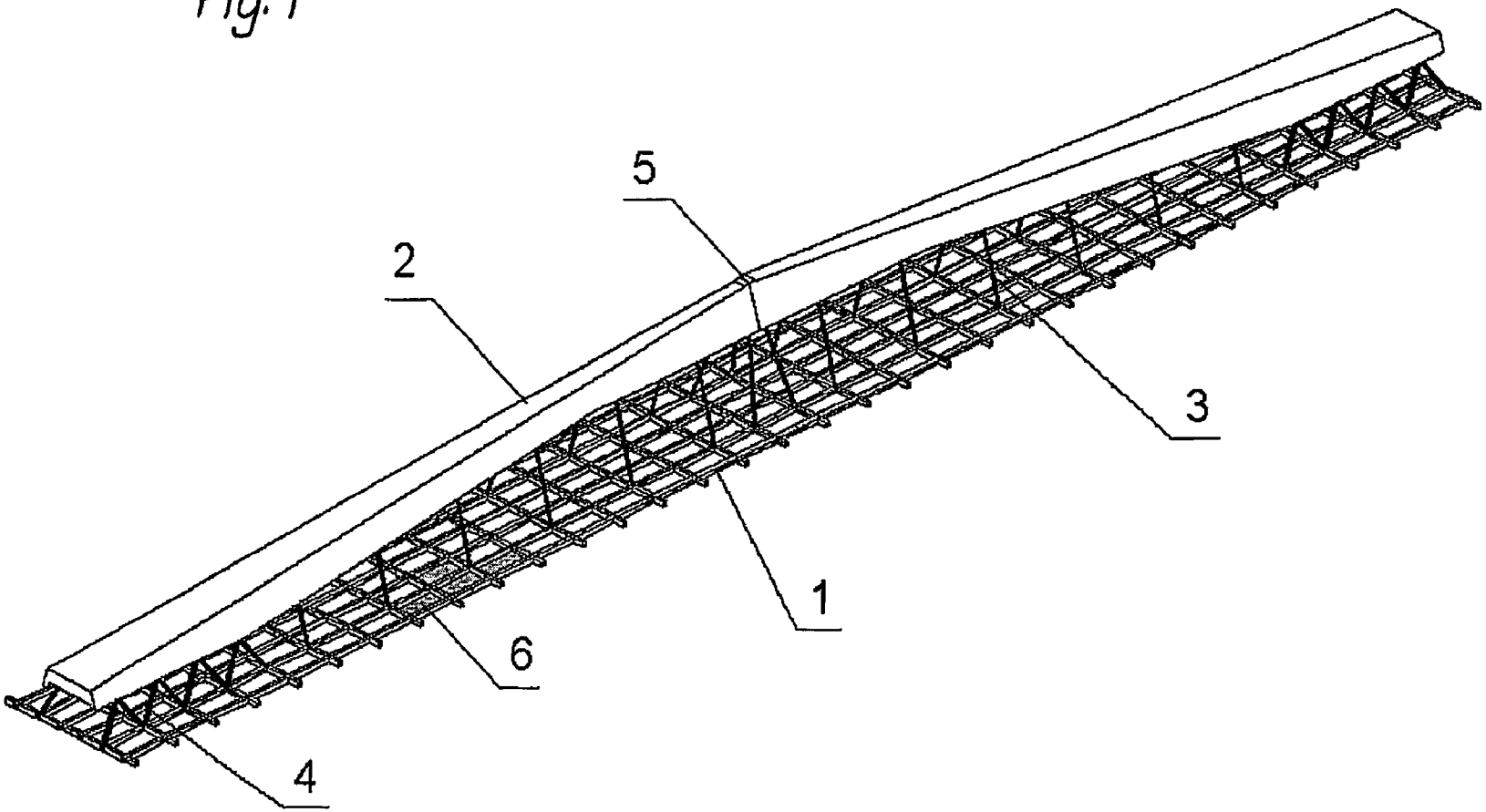
FIG. 1. is an isometric view of the construction with an inverse "V" cross section shape of the upper girder.
Figure 2:
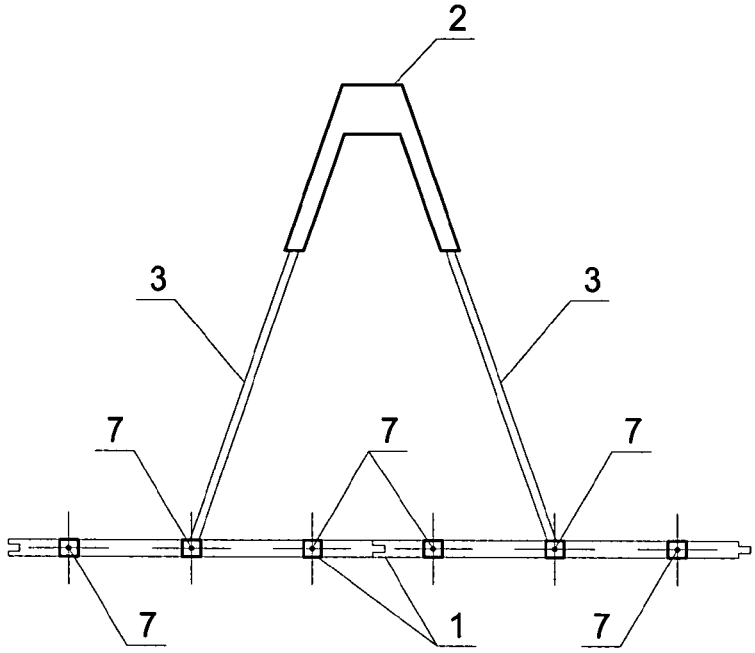
FIG. 2. is the cross section of the construction with an inverse "V" cross section shape.
Figure 3:
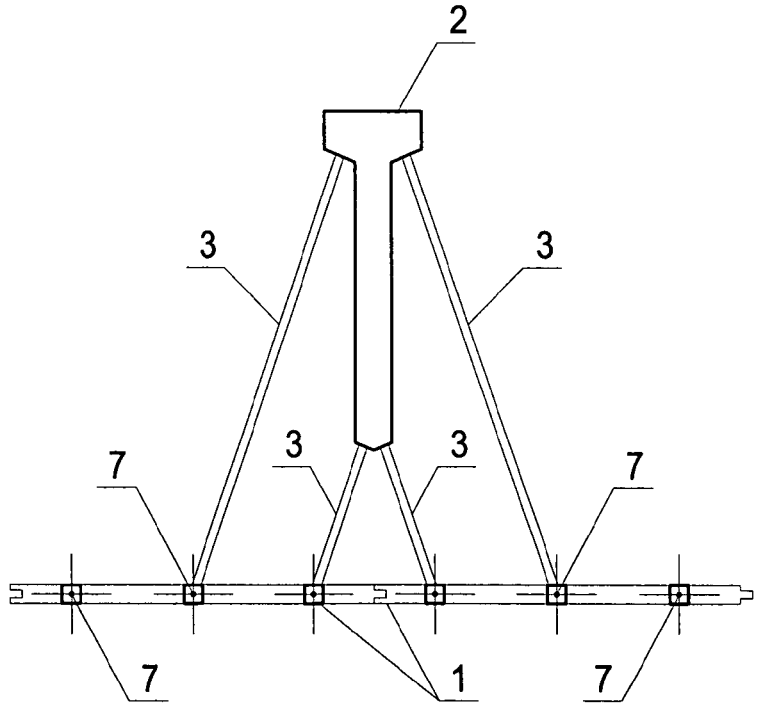
FIG. 3. is the cross section of the construction of an alternate embodiment with "T" cross section shape.

In following, the preferred embodiment with the upper girder (2) of an inverse "V"-shaped cross-section, shown by the isometric view in FIG. 1, is described (as shown also in FIG. 2.). In one another embodiment the construction may comprise the T-shaped cross-section upper girder (2) (as shown in FIG. 3). In both variants the grid soffit (1) can be made of steel tubes or of prestressed concrete independently of the choice of the upper girder cross-section.

The global bearing unit of the construction that is thereafter assembled at the site is shown in FIG. 1. It comprises the distinctly wide grid-assembly construction (1) and the upper girder (2) of the inverse "V"-shaped cross section interconnected by slender pipe-rods (3). The vertically slender horizontal grid construction (1) is chosen of such dimensions that its constitutive parts, illustrated in FIG. 4, can be easily transported to the site and can cover the great part of the site-view of the building at once when assembled into the global bearing unit.

Figure 4:
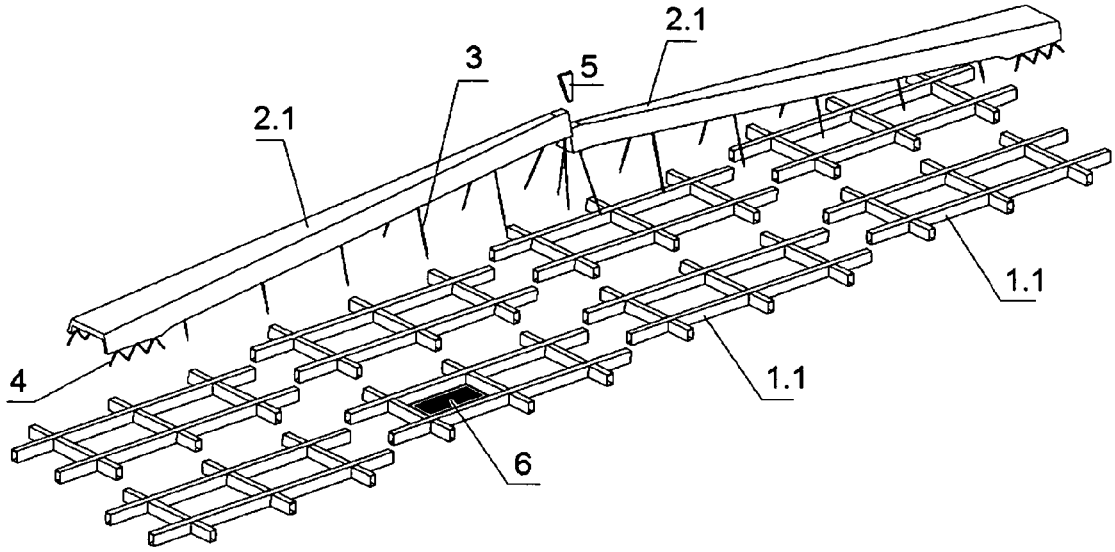
FIG. 4. is an isometric view of the disassembled construction showing its assembly parts.

FIG. 1 is an isometric view to the construction in a variant with the upper girder (2) of inverse "V"-shaped cross-section and with the steel grid (1) applied and FIG. 4 shows the same construction but disassembled. The upper girder (2) is made of two reinforced concrete parts, elements (2.1), prefabricated in a building element factory and transported to the construction site. The grid (1) elements are also manufactured in the factory, of welded steel tubes, in smaller-size parts (1.1) such that the elements can be easily transported to the construction site. Short and stiff pipe-rods (4) used near the supports to interconnect the grid (1) and the upper girder (2) are inbuilt into the upper girder (2) ends as their integral part. Interconnecting steel pipe-rods (3) are separate elements.

Figure 5:
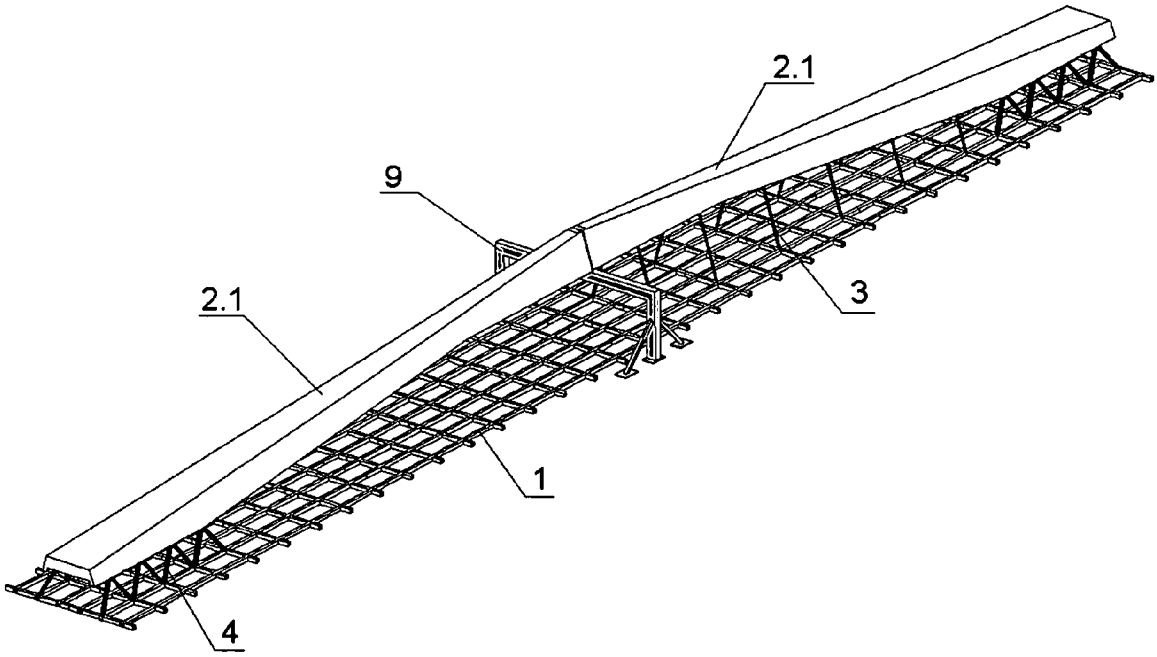
FIG. 5. illustrates the disassembled construction and the method of assembling.
Figure 6:
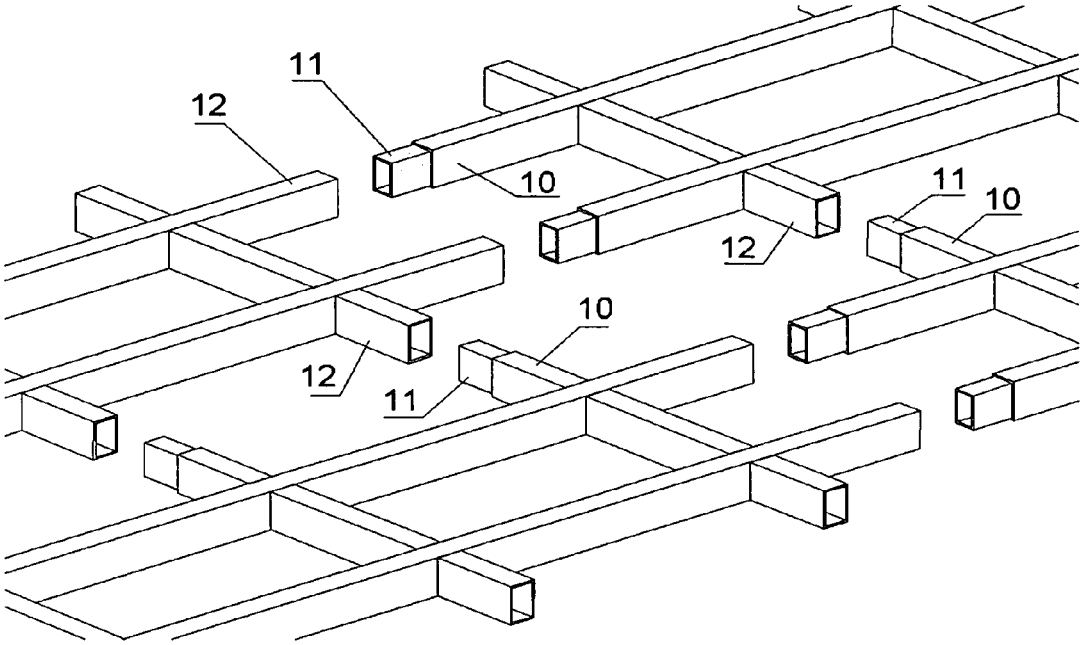
FIG. 6. is the connecting detail for grid elements if the steel grid is applied.
Figure 7:
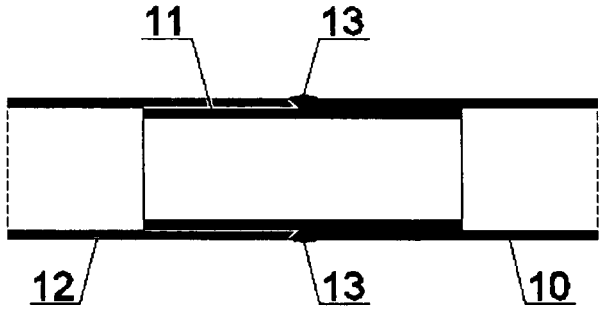
FIG. 7. is a detailed view of the steel grid element joint.

At the constructing site the horizontal plane is to be prepared with plurality of supports on which smaller parts (1.1) of the grid are leaned before being assembled into grid entirety (1), the unit that with its width and length belongs to the bearing area of one assembled upper girder (2) as it is illustrated in FIG. 4 and FIG. 5. In both directions, longitudinally and laterally elements of the girder are interconnected into grid-entirety (1) by details illustrated in FIG. 6. FIG. 7 shows the longitudinal cut-section of the same connecting detail from which it is seen that one end of the steel tube (10) comprises the other inside-welded smaller tube (11) that is utilized to be inserted into an adjacent tube (12) whereby thereafter both tubes (10) and (11) are welded around their contact perimeter by the weld (13). In that way the entire soffit grid is assembled at which in following the whole construction is formed.

At the midspan a temporarily supporting frame (9) is positioned. Both halves (2.1) of the upper girder are then positioned on the grid and are turned each to another with their ends that are to be connected leaned at the midspan on the supporting frame (9) whereby their opposite ends, with incorporated stiff steel-pipe legs (4) were laid on the grid elements as it is shown in FIG. 5 and FIG. 6. Both upper girder halves (2.1) being in that way leaned and fixed are thereafter connected to the grid (1) by welding rods (3) and rods (4) to the grid elements. Short and stiff legs (4) that were incorporated to the upper girder (2) concrete during prefabrication after being welded become the truss-like console supports of the upper girder (2) fix-end connected to the grid. The construction is thereby still disconnected in the midspan of the upper girder (2) but the temporarily supporting frame can be removed.

Figure 8:
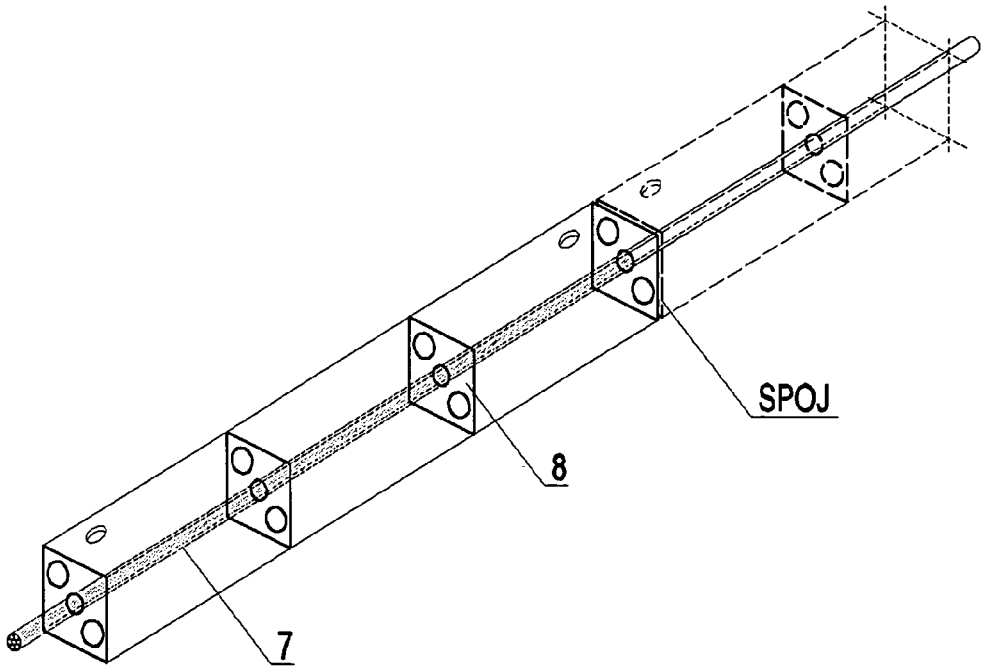
FIG. 8. is the cable conducting detail for longitudinal post-tensioning connection of grid elements when steel grid is applied.

In the longitudinal, bearing direction of the construction because of presence of high tension in grid elements grid (1) is prestressed centrically with cables (7) conducted through grid elements longitudinally as it is shown in FIG. 8. The longitudinal grid elements made of steel tubes are supplied by inbuilt conductors (8) that are used to provide the centric position of the cables in the center of gravity of the cross section inside of tubes. The hollow longitudinal grid elements after being prestressed with cables positioned inside are thereafter fulfilled with expanding foam or with extremely lightweight concrete, dependably on the degree of prestressing and the stability of the grid during prestressing whereby the fulfill material is utilized to protect cables from corrosion and the bond continuity between cables and tubes is ensured. Stability of the grid construction itself during centric prestressing must be controlled with appropriate calculations whereby it is necessary to consider the self-weight and restraining activities of the construction against grid to buckle upwards.

During prestressing of the grid elements (1), the upper girder (2) is disconnected at the midspan whereby both the separated halves (2.1) stand on their own legs (3) and (4) being welded to the grid (1). After prestressing of the grid (1) is done, the upper girder (2) is subjected to another prestressing, by the wedge (5,) driven into a special detail between the two separated halves (2.1), by the method disclosed in U.S. Pat. No. 6,966,159 under the name "Flat soffit, doubly prestressed, composite, roof-ceiling construction for large span industrial buildings". Prestressing of the grid (1) ensures presence of permanent compression inside its longitudinal elements under all applied loads as well as all interconnected joined grid parts (1.1) into the grid entirety (1).

In one another embodiment the "T"-shaped cross section upper girder (2) may be applied with the same steel-tube grid. In that case all the carrying-out procedure remains the same. If now in these two variants the steel-tube grid is replaced by the concrete one, the two additional variants appear.

As a second embodiment the variant with "T"-shaped or inversed "V" cross section upper girder (2) is taken, with the grid (1) of prestressed concrete elements. The elements (1.1) as the assemblies of the grid-soffit (1) are assembled and connected to the entirety in the same manner as in previous variant at the construction site also by means of the same temporary connection.

The grid elements in concrete variant are solid-ones, with centrically incorporated conductors (7), supplied by the same tube connectors at their ends for temporarily assembling of the grid. The difference between joints of concrete and steel variants of the grid is only in details that are adapted to concrete with incorporated tubes at ends of elements that are to be joined. The concrete variant is not emphasized or described because it contains itself nothing new.

In all variants, after the large-size unit of the roof-ceiling construction was completed and prestressed at site the construction is hoisted and joined to adjacent one forming a continuous grid soffit. The grids of the large-size units of the constructions are thereby interconnected to another such units in the same manner as smaller parts (2.1) were interconnected into grid large-unit (1).

Finally the soffit plane is closed by inserting of light plates (6) into openings within grid elements such that a large continuous flat-soffit is achieved.

The invention claimed is:

1. Doubly prestressed roof-ceiling construction for extremely large spans, said construction comprising a flat soffit grid of greater than 50 meters in length, a prestressed upper girder formed of two transversely extending pieces, the two pieces being interconnected by a wedge forced between the two pieces to prestress the upper girder, and interconnecting pipe-rods extending between the soffit grid and the upper girder, the soffit grid including longitudinally interconnected square shaped hollow tubes forming grid elements and cables extending centrally through the square shaped hollow tubes with the cables extending along an entire length of the square shaped hollow tubes, conductor plates located in and extending across a width of said square shaped hollow tubes for prestressing the soffit grid, the cables extending through the conductor plates located in the square shaped hollow tubes, the square shaped hollow tubes being filled with one of hard expanding foam and lightweight concrete for corrosion protection and thermo-insulation of the soffit grid.

2. The construction as claimed in claim 1, wherein lightweight plates are located in openings formed between the square shaped hollow tubes of the grid elements.

3. The construction as claimed in claim 1, wherein adjacent ends of the square shaped hollow tubes are inserted into each other and welded together with an interconnecting hollow tube to form the soffit grid.

4. The construction according to claim 1, wherein the prestressed upper girder and the soffit grid are interconnected by welding the pipe-rods along an entire length of the construction.

5. The construction according to claim 1, wherein the pipe-rods are laterally supported by the soffit grid to stabilize the prestressed upper girder against buckling.

* * * * *